US011266874B2

(12) United States Patent
Spink

(10) Patent No.: US 11,266,874 B2
(45) Date of Patent: Mar. 8, 2022

(54) JAW RANGE OF MOTION DEVICE

(71) Applicant: Michael Spink, Northampton, MA (US)

(72) Inventor: Michael Spink, Northampton, MA (US)

( * ) Notice: Subject to any disclaimer, the term of this patent is extended or adjusted under 35 U.S.C. 154(b) by 334 days.

(21) Appl. No.: 16/400,753

(22) Filed: May 1, 2019

(65) Prior Publication Data

US 2020/0346071 A1 Nov. 5, 2020

(51) Int. Cl.
*A63B 23/03* (2006.01)
*A61H 1/02* (2006.01)

(52) U.S. Cl.
CPC ..... *A63B 23/032* (2013.01); *A61H 1/02* (2013.01); *A61H 2201/0153* (2013.01); *A61H 2201/1253* (2013.01); *A61H 2201/1635* (2013.01); *A61H 2201/1671* (2013.01); *A61H 2205/026* (2013.01); *A63B 2220/20* (2013.01)

(58) Field of Classification Search
CPC ..... A63B 23/032; A63B 2220/20; A63B 21/4039; A63B 21/028; A63B 2209/14; A63B 2225/09; A63B 2209/18; A61H 1/02; A61H 2201/1253; A61H 2201/1635; A61H 2205/026; A61H 2201/0153; A61H 2201/1671; A61H 1/00
See application file for complete search history.

(56) References Cited

U.S. PATENT DOCUMENTS 5,035,420 A * 7/1991 Beeuwkes, III ..... A63B 23/032 482/11
D363,294 S * 10/1995 Ellis ..... D15/139
D411,590 S * 6/1999 Blæsild ..... D21/493
8,167,619 B2 * 5/2012 Vachtenberg ..... A61C 8/0089 433/173
8,628,325 B2 * 1/2014 Vachtenberg ..... A61C 8/0039 433/173
D701,254 S * 3/2014 Carlson ..... D15/127
8,696,720 B2 * 4/2014 Lazarof ..... A61C 8/0071 606/313
D723,119 S 2/2015 Stewart
D739,485 S * 9/2015 Kulzer ..... D21/694
9,408,678 B2 * 8/2016 Harrison ..... A61C 1/085
D766,443 S * 9/2016 Takeda ..... D24/180
D774,597 S * 12/2016 Lowery ..... D21/336
9,788,920 B2 * 10/2017 Lacaze ..... A61B 17/686
(Continued)

OTHER PUBLICATIONS

Atos Medical, TheraBite Jaw Motion Rehabilitation System, 2012, pp. 1-15. Sweden.

(Continued)

*Primary Examiner* — Garrett K Atkinson
(74) *Attorney, Agent, or Firm* — Duquette Law Group, LLC

(57) ABSTRACT

Embodiments of the innovation relate to a jaw range of motion device that includes a conical base having a first end and a second end and a helical ridge carried by the conical base and disposed between the first end and the second end. The helical ridge and the conical base define a channel between adjacent helical ridge portions. The jaw range of motion device also includes a handle disposed at the second end of the conical base. When a user inserts the jaw range of motion device between his teeth, the user can apply a self-directed manual force to the device by generating a twisting motion on the handle to provide an incremental jaw range of motion.

8 Claims, 6 Drawing Sheets

(56) References Cited

U.S. PATENT DOCUMENTS

| | | | | |
|---|---|---|---|---|
| 9,918,764 | B2 * | 3/2018 | Huwais | A61C 8/0025 |
| D837,382 | S * | 1/2019 | Steen | D24/180 |
| D838,785 | S * | 1/2019 | Wonner | D21/505 |
| D854,163 | S | 7/2019 | Vela Hernandez | |
| 10,376,737 | B1 * | 8/2019 | Shepherd | A44C 25/00 |
| D865,077 | S * | 10/2019 | Fontaine | D21/498 |
| 10,569,128 | B2 | 2/2020 | Hirschinger | |
| 10,603,140 | B2 * | 3/2020 | Hall | A61C 8/008 |
| D883,578 | S * | 5/2020 | Howard | D29/108 |
| D887,499 | S * | 6/2020 | Manovi | D21/493 |
| D902,323 | S * | 11/2020 | Park | D21/503 |
| 10,912,595 | B2 * | 2/2021 | Huwais | A61B 17/7035 |
| 2007/0037665 | A1 | 2/2007 | Robbins | |
| 2009/0208905 | A1 * | 8/2009 | Vachtenberg | A61C 8/0039 433/173 |
| 2009/0240289 | A1 * | 9/2009 | Zipprich | A61C 8/0018 606/305 |
| 2012/0058451 | A1 * | 3/2012 | Lazarof | A61B 17/8625 433/173 |
| 2013/0344458 | A1 * | 12/2013 | Taha | A61C 8/0068 433/174 |
| 2014/0099599 | A1 * | 4/2014 | Harrison | A61C 1/084 433/173 |
| 2014/0148864 | A1 * | 5/2014 | Lacaze | A61B 17/844 606/327 |
| 2014/0363787 | A1 * | 12/2014 | Tissi | A61C 8/0033 433/174 |
| 2015/0018890 | A1 * | 1/2015 | Ihde | A61B 17/8605 606/306 |
| 2015/0044638 | A1 * | 2/2015 | Baez | A61C 8/0025 433/174 |
| 2015/0297275 | A1 * | 10/2015 | Huwais | A61C 8/0025 606/315 |
| 2017/0065377 | A1 * | 3/2017 | Hall | A61C 8/0006 |
| 2018/0056121 | A1 * | 3/2018 | Hirschinger | A63B 23/032 |
| 2020/0155210 | A1 * | 5/2020 | Huwais | A61B 17/7035 |
| 2021/0015585 | A1 * | 1/2021 | Bork | A61C 1/088 |

OTHER PUBLICATIONS http://www.dynasplint.com/divisions/jaw, visited Jun. 4, 2019, Dynasplint Systems, Inc., Jaw Dynasplint System, 2012, pp. 1-4, Canada and Europe.

* cited by examiner

JAW RANGE OF MOTION DEVICE

BACKGROUND

Exercise of jaw muscles is an important post-treatment therapy for a variety of medical procedures, such as mandible reconstruction, head and neck radiation therapy, and temporomandibular joint (TMJ) surgery. For example, following mandible reconstruction, a surgeon may wire the patient's jaws closed as a splinting procedure. However, this can lead to a shortening of the muscles that close the jaw and a weakening of the muscles that open it. As a result, the patient may utilize a variety of jaw exercises to stretch the muscles and to regain freedom of motion.

In certain cases, a patient may utilize a relatively low cost, manual exercise regimen to stretch the jaw muscles. For example, the patient can apply digital pressure to the upper and lower jaws to stretch the jaw muscles along a vertical direction. In another example, the patient can sequentially disposing tongue depressors between his maxillary and mandibular teeth in order to slowly increase the distance between his jaws, thereby stretching his jaw muscles.

In other cases, a patient may utilize alternate exercise regimens using more costly jaw range of motion devices to stretch the jaw muscles. For example, one such device, DYNASPLINT (Dynasplint Systems, Inc., Severna Park, Md.), is a spring-loaded device having bilateral platforms which are configured to displace the patient's jaws to improve the range of motion. In another example, THERABITE (Atos Medical Inc., New Berlin, Wis.) is a patient controlled passive motion device. This device includes two opposing platforms which a patient place in his mouth. The user applies pressure to the platforms using a lever to passively displace the patient's jaws to improve the range of motion.

SUMMARY

Conventional exercise regimens suffer from a variety of deficiencies. For example, as provided above, a patient can manually apply pressure to his jaws to stretch the jaw muscles. However, the effectiveness of this exercise regimen is limited. For example, during the exercise regimen the patient may not apply consistent manual pressure to the jaws over time. In the case where the patient applies too little pressure, the jaw muscles may not be effectively stretched. In the case where the patient applies too much pressure, he may injure the jaw muscles. In either situation, the lack of progress and possible injury can demotivate the patient from continuing with the therapy, thereby leading to a poor post-treatment outcome.

Also, as provided above, patients may utilize jaw range of motion devices to stretch the jaw muscles. However, conventional jaw range of motion devices are relatively costly, which can result in certain patients, such as low-income patients, being excluded from receiving their benefits. As provided above, conventional jaw range of motion devices typically include a number of components and mechanisms to apply pressure to a patient's jaws. With the relatively complex design of the jaw range of motion devices, the devices can experience mechanical failure. In the case of failure, this can lead to a patient not continuing with the jaw muscle exercise regimen, and can lead to a poor post-treatment outcome. Further, these conventional jaw range of motion devices require the user to actuate springs and/or levers in order to activate the device. For patients with limited hand dexterity or hand strength, the conventional devices might not be useable which, again, can lead to the patient not continuing with the therapy.

By contrast to conventional jaw exercise devices, embodiments of the present innovation relate to a jaw range of motion device. In one arrangement, the jaw range of motion device includes a conical base having an angle of inclination extending along a longitudinal axis of the device. The jaw range of motion device also includes a helical ridge which defines a channel relative to the conical base.

During operation, a user inserts the smaller diameter end of the jaw range of motion device into his mouth and places his maxillary and mandibular teeth into the channel. As the user rotates the jaw range of motion device in a clockwise direction, via a handle, the jaw range of motion device rotates relative to the user's teeth. Such motion causes the channel and helical ridge to advance into the user's mouth while the angle of inclination of the conical base increases the distance between the user's jaws. When the user reaches a maximum jaw extension position, the user can rotate the device in a counter clockwise direction to extract the channel and helical ridge from the user's mouth and to decrease the distance between the user's jaws. The user can repeat this process according to a given exercise regimen to improve the range of motion, such as following a surgical procedure.

Based upon its configuration, the present jaw range of motion device is relatively low cost which makes almost universally accessible and is relatively easy to use regardless of a user's dexterity or strength. Further, the configuration of the jaw range of motion device lacks moving parts and is relatively durable. Additionally, the jaw range of motion device is manufactured from biocompatible materials and can be easily cleaned.

Embodiments of the innovation relate to a jaw range of motion device that includes a conical base having a first end and a second end and a helical ridge carried by the conical base and disposed between the first end and the second end. The helical ridge and conical base define a channel between adjacent helical ridge portions. The jaw range of motion device also includes a handle disposed at the second end of the conical base.

BRIEF DESCRIPTION OF THE DRAWINGS

The foregoing and other objects, features and advantages will be apparent from the following description of particular embodiments of the innovation, as illustrated in the accompanying drawings in which like reference characters refer to the same parts throughout the different views. The drawings are not necessarily to scale, emphasis instead being placed upon illustrating the principles of various embodiments of the innovation.

DETAILED DESCRIPTION

Figure 1:
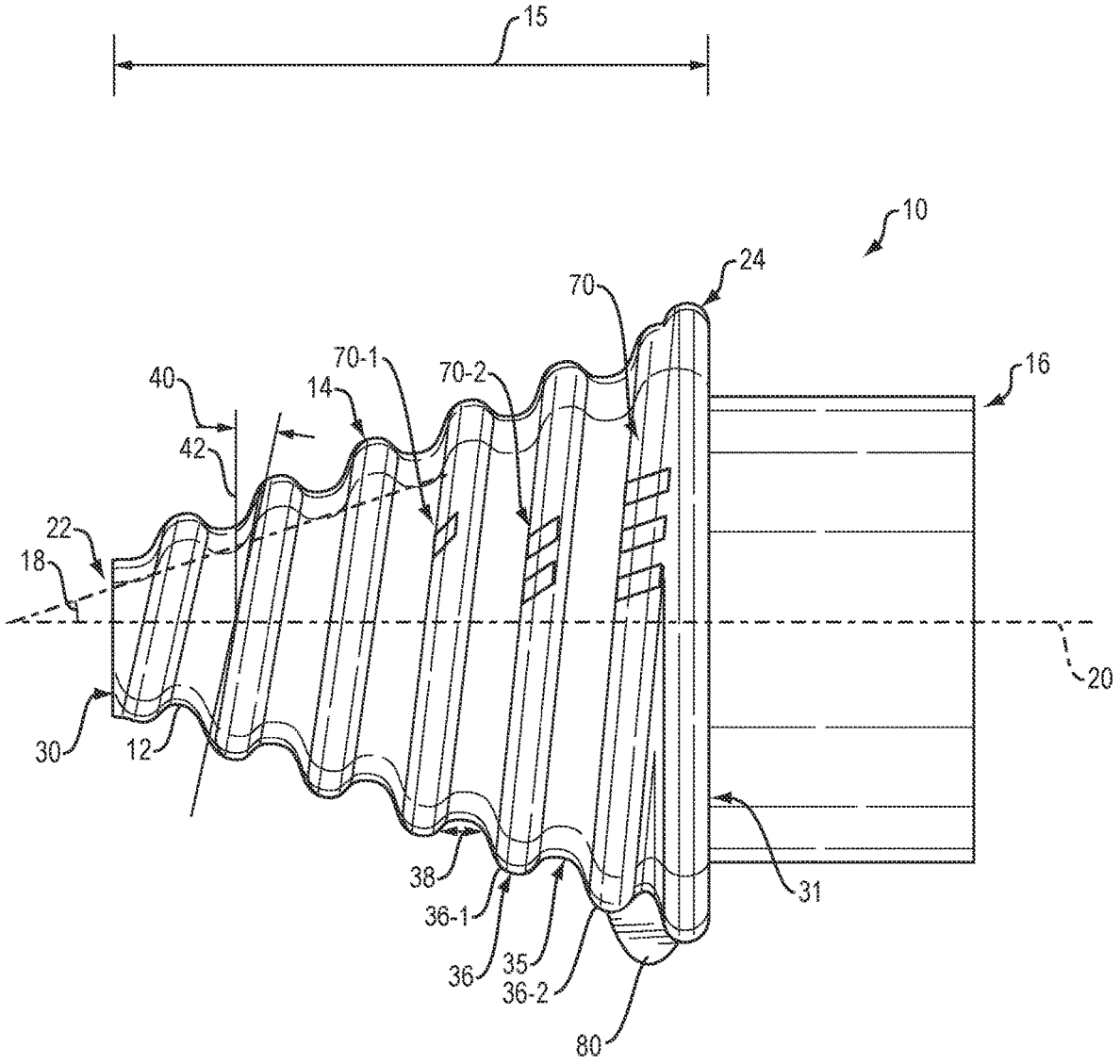
FIG. 1 illustrates a side view of a jaw range of motion device, according to one arrangement.
Figure 2:
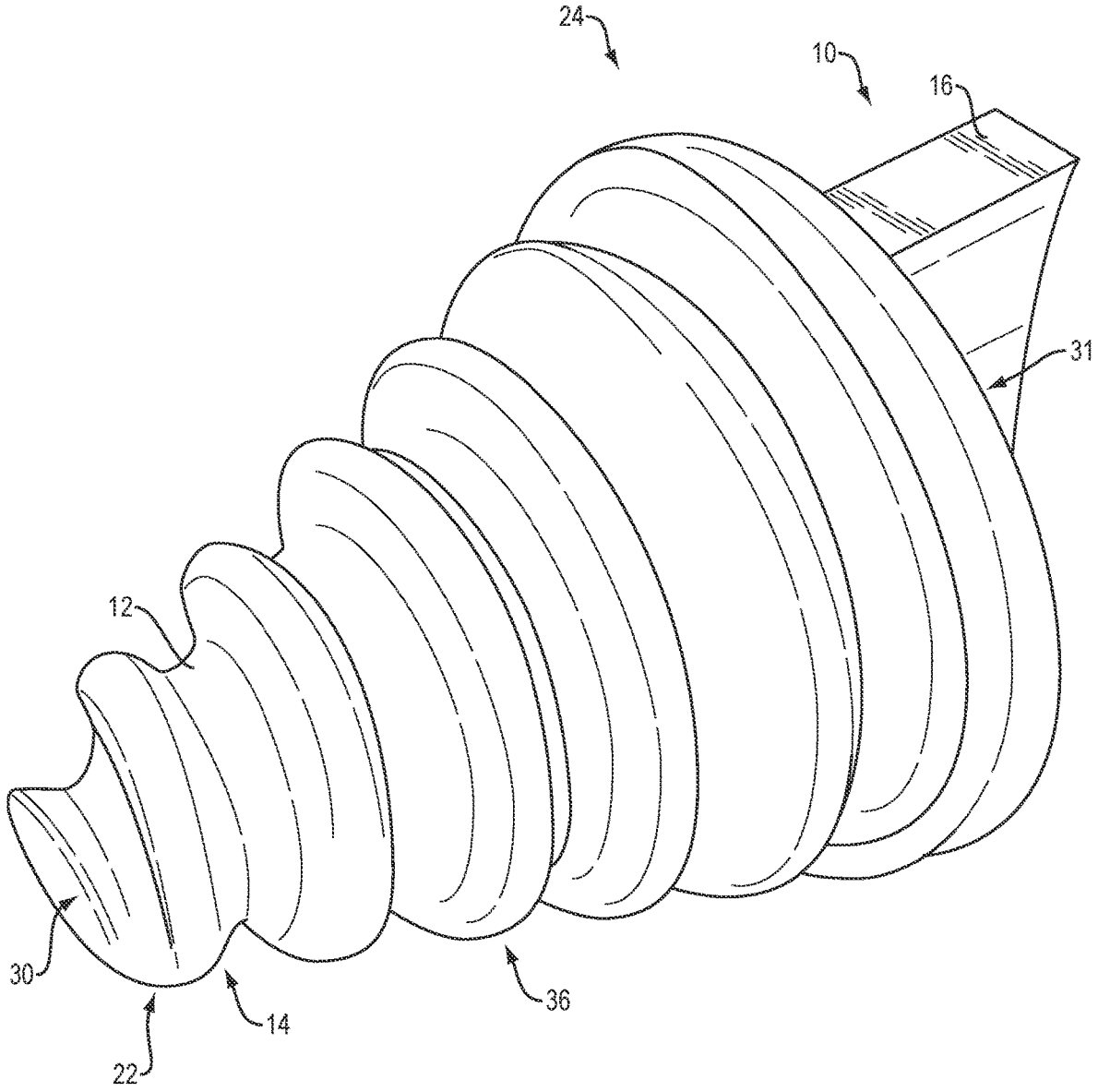
FIG. 2 illustrates a top perspective view of the jaw range of motion device of FIG. 1, according to one arrangement.
Figure 3:
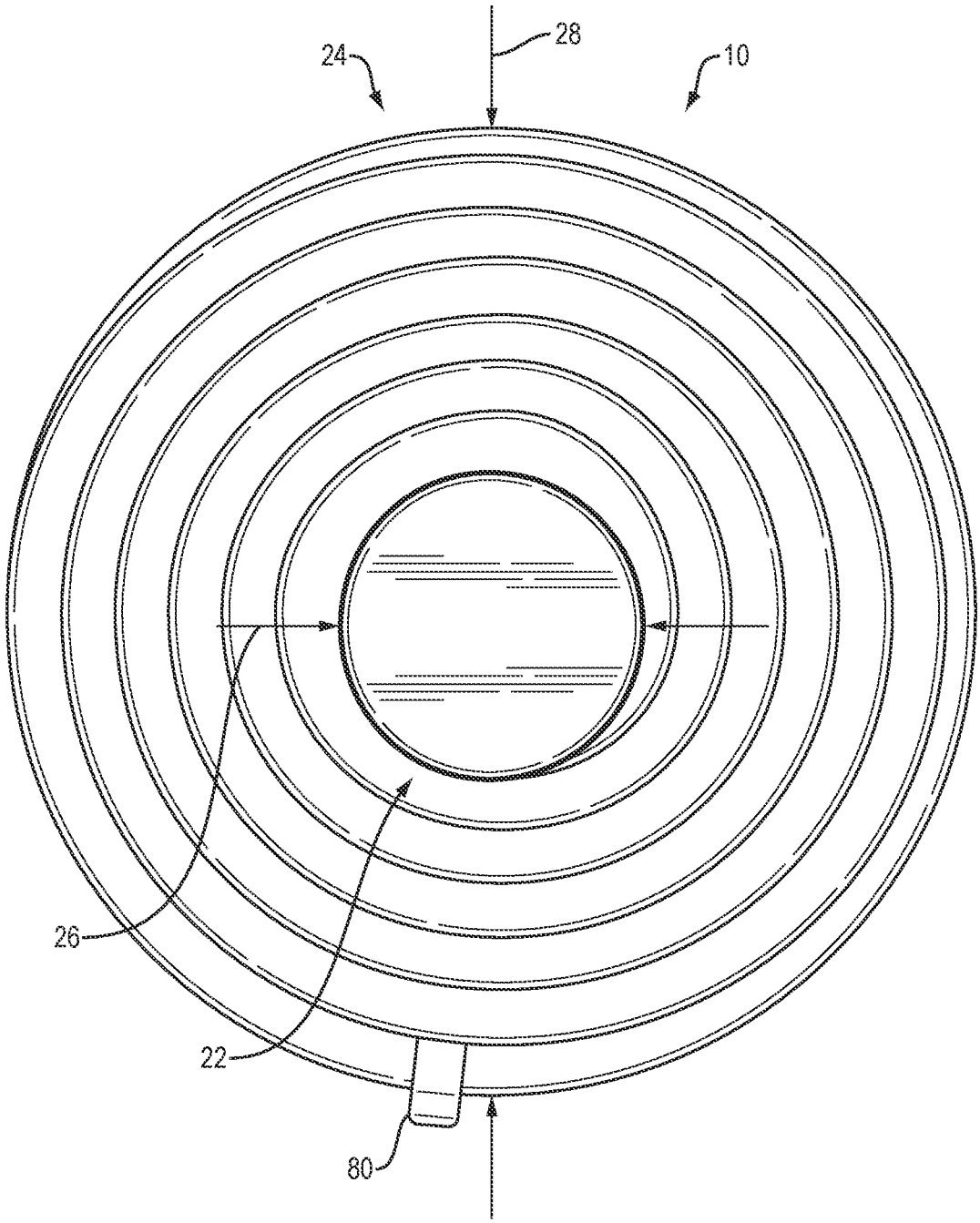
FIG. 3 illustrates a front view of the jaw range of motion device of FIG. 1, according to one arrangement.
Figure 4:
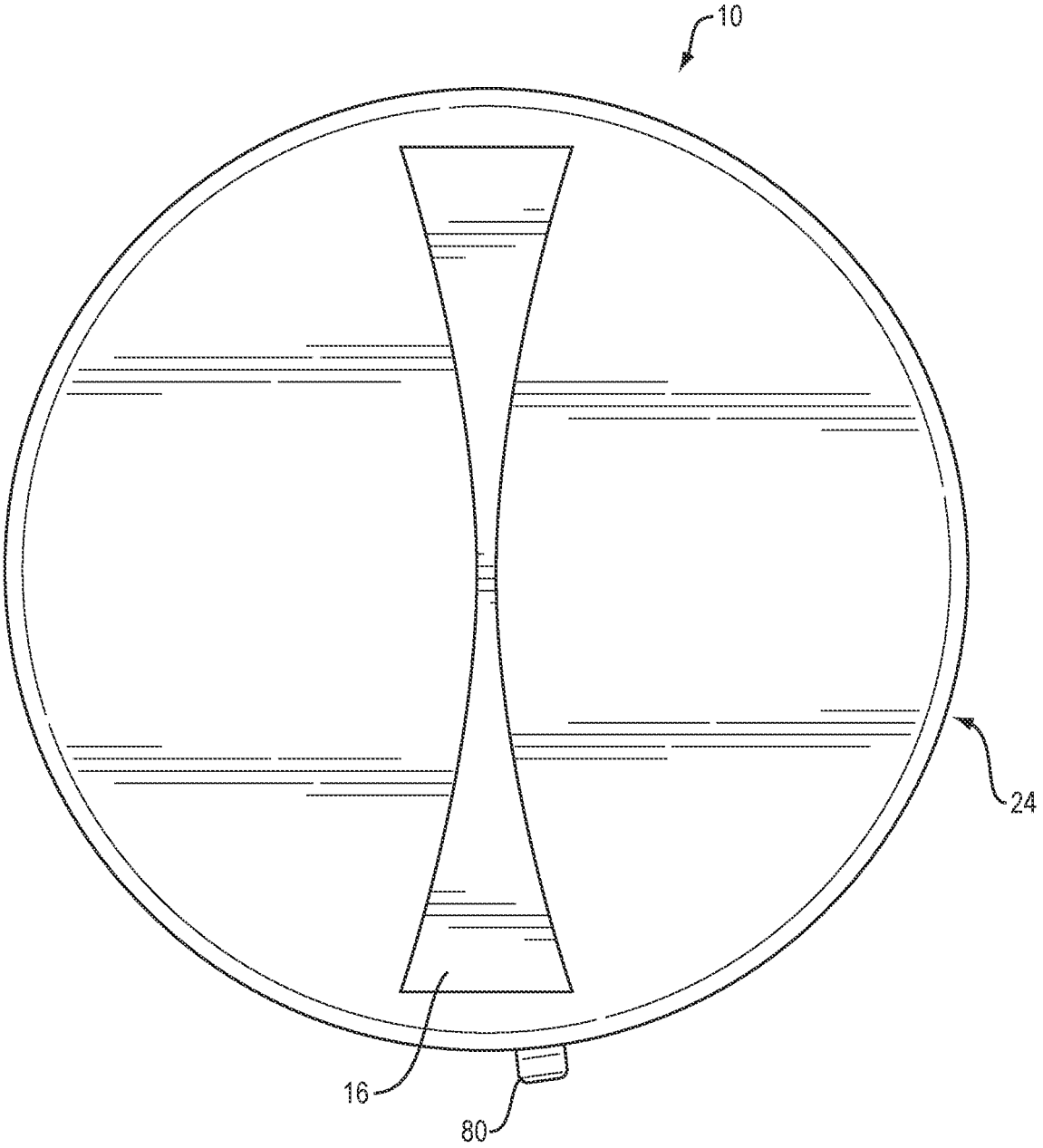
FIG. 4 illustrates a rear view of the jaw range of motion device of FIG. 1, according to one arrangement.

Embodiments of the present innovation relate to a jaw range of motion device. In one arrangement, the jaw range of motion device includes a conical base having an angle of inclination extending along a longitudinal axis of the device. The jaw range of motion device also includes a helical ridge which defines a channel relative to the conical base.

During operation, a user inserts the smaller diameter end of the jaw range of motion device into his mouth and places his maxillary and mandibular teeth into the channel. As the user rotates the jaw range of motion device in a clockwise direction, via a handle, the jaw range of motion device rotates relative to the user's teeth. Such motion causes the channel and helical ridge to advance into the user's mouth while the angle of inclination of the conical base increases the distance between the user's jaws. When the user reaches a maximum jaw extension position, the user can rotate the device in a counter clockwise direction to extract the channel and helical ridge from the user's mouth and to decrease the distance between the user's jaws. The user can repeat this process according to a given exercise regimen to improve the range of motion, such as following a surgical procedure.

FIGS. 1-4 illustrate a jaw range of motion device 10 according to one arrangement. As illustrated, the jaw range of motion device 10 includes a conical base 12, a helical ridge 14 carried by the conical base 12, and a handle 16.

The conical base 12 is configured to provide an inclined support for a user's maxillary and mandibular teeth when a user places the jaw range of motion device 10 in his mouth and actuates the device 10 during use. For example, the conical base 12 defines a length 15 of about 45 mm an angle of inclination 18 of between about 40° and 55° relative to a longitudinal axis 20 and a first end 22 of the jaw range of motion device 10. This angle of inclination 18 defines a relatively gradual increase in the root diameter of the jaw range of motion device 10 from the first end 22 to a second end 24 of the device 10. For example, with reference to FIG. 3, the angle of inclination 18 can provide an increase in the root diameter of the device 10 from the first end 22 to the second end 24. With such a relatively gradual increase in the root diameter, the jaw range of motion device 10 can provide the user with a relatively gradual widening of the jaws during a jaw stretching procedure.

In one arrangement, the first end 22 of the jaw range of motion device 10 defines a first face 30 having a substantially vertical surface relative to the longitudinal axis 20 of the jaw range of motion device 10. For example, the first face 30 can be disposed substantially perpendicular to the longitudinal axis 20 and can define a first root diameter 26 that can accommodate the smallest user mouth opening that can be provided to the user. Further, the second end 24 of the jaw range of motion device 10 defines a second face 31 having a substantially vertical surface relative to the longitudinal axis 20 of the device 10. The second face 31 can be disposed substantially perpendicular to the longitudinal axis 20 and can define a second root diameter 28 that can accommodate the largest user mouth opening that can be provided to the user.

The root diameters 24, 28 for both the first and second end 22, 24 can have a variety of sizes. As such, the conical base 12 can define a first root diameter 26 equivalent to a relatively modest post-therapy incisal opening. In one arrangement, the conical base 12 can define a first root diameter 26 equivalent to a relatively modest post-therapy incisal opening and a second root diameter 28 equivalent to an average maximal incisal opening (e.g., TMJ full range of motion).

For example, following a surgical procedure, a user may have limited jaw motion and may require device 10 having a relatively small first root diameter 26. In such a case, with reference to FIG. 3, the first end 22 can define a first root diameter 26 of 10 mm and the second end 24 can define a second root diameter 28 of 30 mm. In another example, as the user progresses with the jaw range of motion exercises, the first root diameter 26 can be relatively larger. In one case (i.e., design for a leveraged class III ginglymoarthroidal (TMJ) opening), with continued reference to FIG. 3, the first end 22 can define a first root diameter 26 of 20 mm and the second end 24 can define a second root diameter 28 of 40 mm. In another case (i.e., design for a leveraged class III ginglymoarthroidal (TMJ) opening) the first end 22 can define a first root diameter 26 of 30 mm and the second end 24 can define a second root diameter 28 of 50 mm.

The helical ridge 14 is disposed between the first end 22 and the second end 24 of the conical base 12. In one arrangement, the helical ridge 14 can be integrally formed with the conical base 12. Alternately, the helical ridge 14 can be configured as a component coupled to the conical base 12 via a coupling mechanism, such as a chemical or mechanical coupling mechanism.

The helical ridge 14 is configured to provide a support and guide for a user's maxillary and mandibular teeth during use of the device 10. In one arrangement, with reference to FIG. 1, the helical ridge 14 and the conical base 12 define a channel 35 between adjacent helical ridge portions 36. For example, as illustrated, the adjacent helical ridge portions 36-1, 36-2 and the portion of the conical base 12 disposed at the base of the adjacent portions 36-1, 36-2 define channel 35. The channel 35 is sized to accept the thickness of a user's tooth. For example, the channel 35 defines an axial channel width 38 of between about 3 mm and 6 mm. The channel 35 allows the user's maxillary and mandibular teeth to fit passively between adjacent helical ridge portions 36-1, 36-2 and to slide relative to the portions 36-1, 36-2 during use. Accordingly, the channel 35

In one arrangement, with reference to FIG. 1, the helical ridge 14 is disposed at a helix angle 40 relative to a vertical axis 42. The helix angle 40 defines the incremental opening of the user's jaws as the user rotates the jaw range of motion device 10 during use. While the helical ridge 14 can define a variety of helix angle 40, in one arrangement, the helical ridge 14, can define a helix angle of between about 7° and 13°.

The handle 16 is disposed at the second end 24 of the conical base 12. In one arrangement, the handle 16 can be integrally formed with the conical base 12. Alternately, the handle 16 can be configured as a component coupled to the conical base 12 via a coupling mechanism, such as a chemical or mechanical coupling mechanism. The handle 16 is configured as a lever to provide the user with a mechanical advantage while rotating the jaw range of motion device 10 during use. For example, the handle 16 can be configured with a hypocycloid shape which provides the user with an ergonomic gripping surface and provides the user's thumb with additional torque during rotation, relative to a flat handle.

In one arrangement, the jaw range of motion device 10 can be manufactured as a single element construct. That is, the conical base 12, the helical ridge 14, and the handle 16 can be integrally formed as a single unit. With such a configuration, the jaw range of motion device 10 does not include moving elements which can experience failure, as in conventional devices.

Further, the jaw range of motion device 10 can be manufactured using a variety of manufacturing methods. For example, the jaw range of motion device 10 can be printed using a three-dimensional (3D) printer, which can allow for on-site customization. In another example, the jaw range of motion device 10 can be machined from a single piece of material using known milling techniques or cast using known casting techniques.

The jaw range of motion device 10 can be constructed from a variety of biocompatible materials, such as those that can be readily washed or sterilized. For example, the device 10 can be constructed from a thermoplastic material, such as when generated from 3D printer. In another example, the jaw range of motion device 10 can be manufactured from a rubber material.

Figure 5:
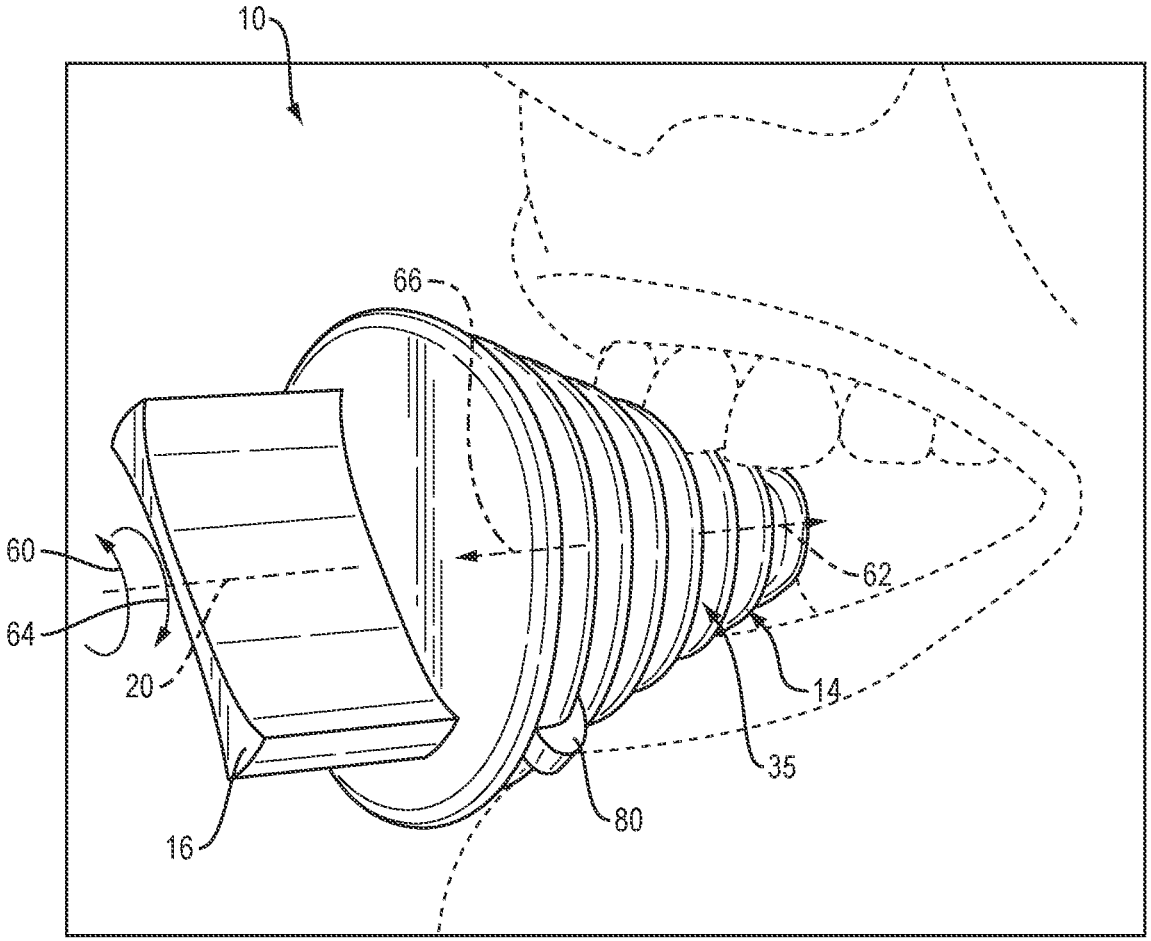
FIG. 5 illustrates the jaw range of motion device of FIG. 1 in use, according to one arrangement.
Figure 6:
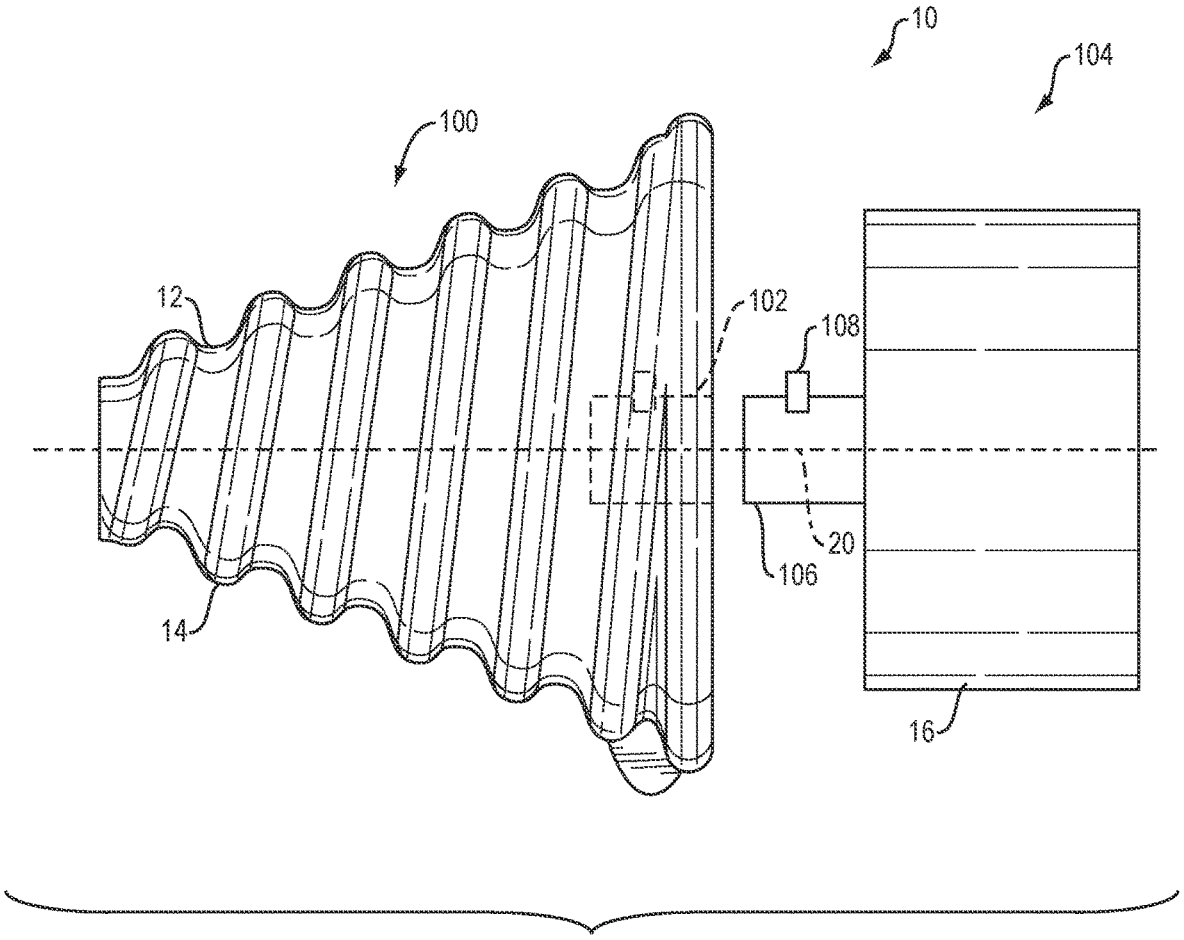
FIG. 6 illustrates an alternate arrangement of the jaw range of motion device of FIG. 1, according to one arrangement.

FIG. 5 illustrates an example use of the jaw range of motion device 10. Initially, a user inserts the first end 22 of the jaw range of motion device 10 into his mouth and places his maxillary and mandibular teeth into the channel 35. The user then grasps the handle 16 between his thumb and forefinger and rotates the jaw range of motion device 10 in a clockwise direction 60 about longitudinal axis 20 and relative to himself. As such, the jaw range of motion device 10 rotates relative to the user's teeth. This rotation causes the channel 35 and helical ridge 14 to advance along a first direction 62 into the user's mouth which, in turn, causes the conical base 12 to increase a distance between the user's jaws.

When the user reaches a maximum jaw extension position, the user then rotates the jaw range of motion device 10 in a counterclockwise direction 62 about longitudinal axis 20 and relative to himself. This rotation causes the channel 35 and helical ridge 14 to advance along a second direction 66 from the user's mouth which, in turn, causes the conical base 12 to decrease the distance between the user's jaws. The user can repeat this process according to a given exercise regimen to improve the range of motion, such as following a surgical procedure. For example, according to a particular jaw exercise regimen, the user can perform the clockwise rotation and counterclockwise rotation ten times in a row for ten times over the course of a day.

As provided above, the jaw range motion device 10 is configured as an integrally formed, single construct element and can be fabricated using a relatively low-cost manufacturing method, such as by 3D printing or milling. Accordingly, the device 10 can be produced from biocompatible materials at a relatively low cost compared to conventional jaw range of motion devices, thereby allowing relatively universal access. Further, based upon the configuration of the conical base 12, the helical ridge 14, and the handle 16, the jaw range motion device 10 is relatively easy to use, regardless of the dexterity or strength of the user.

In one arrangement, the jaw range motion device 10 is configured to provide feedback to the user regarding the user's progress with a given exercise regimen.

For example, as indicated in FIG. 1, the jaw range motion device 10 can include a visual indicator, such as a set of depth markers 70, disposed the conical base 12 or the helical ridge 14. The depth markers 70 can identify an amount of separation of a user's jaws during use and can indicate the user's progress through a therapy regimen. For example, assume the case where at the start of the exercise regimen, such as following jaw surgery, the user can only advance the jaw range motion device 10 into his mouth up to the first set of depth markers 70-1. Further assume that this set of depth markers 70-1 indicates that the user has achieved 50% of total range of motion of his jaw muscles. Over time, as the user continues to perform the jaw exercises, the user can track his progress relative to the first set of depth markers 70-1. For example, when the user can advance the device into his mouth up to the second set of depth markers 70-2, the markers 70-2 can indicate that the user's recovery is advancing and that the user has achieved greater than 50% of total range of motion of his jaw muscles.

In another example, as indicated in FIG. 1, the jaw range of motion device 10 can include a governor or stop element 80 disposed within the channel 35 between adjacent helical ridge portions 36 at the second end 24 of the conical base 12. The stop element 80 can be configured as a tab or flat sheet of material that extends from the channel 35 along a direction that is substantially perpendicular to the longitudinal axis 20 of the device 10. During use, as the user rotates the jaw range motion device 10 to displace his jaws, the user advances the stop element 80 into his mouth as well. In the case where the stop element 80 comes into contact with either the user's maxillary and mandibular teeth, the stop element 80 can provide tactile feed back to the user regarding a maximum depth position of the device 10 within the user's mouth. The stop element 80, as such, can limit further rotation or over insertion of the device 10, thereby mitigating injury to the user.

As indicated in FIG. 1, the stop element 80 can be fixedly attached to the jaw range of motion device 10. For example, the stop element 80 can be integrally formed within the channel 35 between adjacent helical ridge portions 36. In one arrangement, the stop element 80 can be removeably coupled to the jaw range of motion device 10. For example, the stop element 80 can be configured as a movable gauge disposed within the channel 35 between adjacent helical ridge portions 36. In use, a user can decouple the stop element 80 from the jaw range of motion device 10, can slide the stop element 80 within the channel 35 along the spiral helix, and can recouple the stop element 80 to the device 10 at any location within the channel 35. With such a configuration, the stop element 80 acts as a depth indicator which allows the user gauge his progress and guide his ongoing therapy.

As indicated above, the conical base 12, the helical ridge 14, and the handle 16 of the jaw range motion device 10 can be integrally formed into a single unit. Such description is by way of example only. In one arrangement, the handle 16 can be selectively connected to the conical base 12.

For example, the jaw range motion device 10 can include a first device portion 100 and a separable second device portion 104. The first device portion 100 can include the conical base 12 and the helical ridge 14 and can define an opening 102, such as extending along the longitudinal axis of the conical base 12. The second device portion 104 can include the handle 16 and a connection member 106, such as an elongate shaft extending from the handle 16 along the longitudinal axis 20. The jaw range motion device 10 can also include a coupling mechanism 108 disposed between the opening 108 and the connection member 106 configured to selectively secure the first device portion 100 to the second device portion 104. As such, a user can connect and disconnect the first device portion 100 relative to the second device portion 104. With this configuration, as the user progresses with his therapy, the user can attach increasingly larger diameter conical bases 12 to the handle 16.

While various embodiments of the innovation have been particularly shown and described, it will be understood by those skilled in the art that various changes in form and details may be made therein without departing from the spirit and scope of the innovation as defined by the appended claims.

What is claimed is:

1. A jaw range of motion device, comprising:

a conical base having a first end and a second end, wherein the conical base defines, relative to the first end and a longitudinal axis of the conical base, an angle of inclination of between about 40° and 55° , wherein the first end of the conical base defines a first root diameter of between about 10 millimeters and 30 millimeters, and wherein the second end of the conical base defines a second root diameter of between about 30 millimeters and 50 millimeters;

a helical ridge carried by the conical base and disposed between the first end and the second end, the helical ridge and conical base defining a channel between adjacent helical ridge portions; and a handle disposed at the second end of the conical base.

2. The jaw range of motion device of claim 1, wherein the helical ridge defines a helix angle of between about 7° and 13° .

3. The jaw range of motion device of claim 1, wherein the channel defined between adjacent helical ridge portions comprises an axial channel width of between about 3 millimeters and 6 millimeters.

4. The jaw range of motion device of claim 1, wherein the handle comprises a hypocycloid shape.

5. The jaw range of motion device of claim 1, further comprising a set of depth markers disposed on at least one of the conical base and the helical ridge, the depth markers configured to identify an amount of separation of a user's jaws.

6. The jaw range of motion device of claim 1, further comprising a stop element disposed within the channel between adjacent helical ridge portions at the second end of the conical base.

7. The jaw range of motion device of claim 1, wherein the conical base, the helical ridge, and the handle are integrally formed.

8. The jaw range of motion device of claim 1, wherein the handle is selectively connectable to the conical base.

* * * * *